United States Patent [19]

Delgrange et al.

[11] Patent Number: 4,636,784

[45] Date of Patent: Jan. 13, 1987

[54] PROCESS FOR THE CONTROL OF AN ALTERNATING CURRENT PLASMA PANEL AND APPARATUS FOR PERFORMING THE SAME

[75] Inventors: Louis Delgrange; Francoise Vialettes, both of St. Egreve, France

[73] Assignee: Thomson-CSF, Paris, France

[21] Appl. No.: 613,904

[22] Filed: May 24, 1984

[30] Foreign Application Priority Data

Jun. 3, 1983 [FR] France ..... 83 09289

[51] Int. Cl.[4] ..... G09G 3/28

[52] U.S. Cl. ..... 340/771; 340/776; 340/811

[58] Field of Search ..... 340/776, 777, 771, 811

[56] References Cited

U.S. PATENT DOCUMENTS 4,415,892 11/1983 Marentic ..... 340/776

FOREIGN PATENT DOCUMENTS 0047692 3/1982 European Pat. Off. .

0078193 5/1983 European Pat. Off. .

1414340 11/1975 United Kingdom .

*Primary Examiner*—Marshall M. Curtis

*Attorney, Agent, or Firm*—Roland Plottel

[57] ABSTRACT

According to the present invention, an alternating current plasma panel is controlled in the following way, when it is wished to replace one information by another:

an electrode on one of the systems is selected;

at least one group of electrodes with at least one electrode to be activated is addressed on the other system or second system;

the complementary electrodes of those to be activated are selected on the second system;

voltages are applied to the electrodes making it possible to only erase the selected electrodes;

the electrodes to be activated are selected on the second system;

voltages are applied to the electrodes making it possible to effect a writing only on the selected electrodes.

9 Claims, 6 Drawing Figures

PROCESS FOR THE CONTROL OF AN ALTERNATING CURRENT PLASMA PANEL AND APPARATUS FOR PERFORMING THE SAME

BACKGROUND OF THE INVENTION

1. Field of the Invention

The present invention relates to a process for the control of an alternating current plasma panel, as well as to an apparatus for performing the same.

2. Description of the Prior Art

A plasma panel is a device making it possible to display characters, figures and curves, i.e. bidimensional images obtained by combining zones or "points" of a surface, which are made bright by appropriate controls. Such devices are well known to the Expert and are more particularly described in the article which was published in "Revue Technique THOMSON-CSF", June 1978, vol. 10, no. 2, pp. 249 to 275.

More specifically a plasma panel is a juxtapositioning of a large number of cells arranged in matrix-like manner, each cell comprising a gas-filled space, located at the intersection of two electrodes belonging to two orthogonal electrode systems and which are subject to control signals constituted by the difference between voltages applied to the two electrodes between which it is located.

In general, three types of control signals are used in plasma panels, namely entering or writing signals, which switch on the cells, erase signals which switch off the cells and maintenance signals which maintain the cells in their initial state, i.e. either the switched on or the switched off state.

However, unlike the maintenance signals applied to all the electrodes of the panel for ensuring the display of the entered information, the writing and erase signals are selective signals which may only bring about writing and erasure for the selected cells. Thus, a random cell xy is only written or erased if its two electrodes x and y receive adequate voltages Vx and Vy making it possible to obtain the writing or erase signal at the terminals of this single cell.

Therefore, the control electronics must incorporate circuits making it possible to selectively apply to the electrodes the voltages necessary for the operation of the panel. Various alternating plasma panel control circuits have been described in the prior art and particular reference is made to the article published by Texas Instruments, in November 1980 Bulletin SCA-204 and entitled "A.C. Plasma Display", as well as French Patent Application No. 81 19941 in the name of THOMSON-CSF, and corresponding U.S. patent application Ser. No. 431,152, which disclosed integrated circuits making it possible to control A.C. plasma panels.

These integrated circuits essentially comprise a low voltage logic part defining the signal to be effected, its duration and the electrodes of the panel to which the signal is applied, as well as a low voltage-high voltage interface which is controlled by the logic part, said interface making it possible to apply, to the electrodes of the panels, signals having a variable amplitude and duration as a function of the instruction to be carried out.

The logic part essentially comprises series-parallel shift registers and a decoding and validation system. Therefore, the logic addresses or data designating the active and inactive electrodes are entered in series into the shift registers and are then obtained in parallel at the outputs of the registers, which respectively correspond to the electrodes of the plasma panel. An instruction defining the writing or erase signal to be applied to the active electrodes then validates the parallel outputs of the registers towards the low voltage (LV)–high voltage (HV) interface.

In order to permit the easy display of a text or graphic symbol, the most complicated plasma panel control circuits must permit operation in two modes, namely a superimposing mode permitting the writing or erasure of one or more points without modifying the other points and a replacement mode making it possible to replace the information displayed on a segment or part of a vertical or horizontal segment by new information.

However, in order to carry out an information replacement, the solution which is conventionally used consists of supplying an erase instruction to all the points of the segment or of the part of the segment which is to be modified, followed by the entry or writing in of the points to be switched on. This control process suffers from a certain number of disadvantages. It takes a long time, because it is firstly necessary to reenter the address of all the electrodes of a segment to be erased and then the address of only those electrodes which are to be entered. In addition, the writing of a point immediately after its erasure causes problems with respect to the stabilization of the charges at the cell terminals.

SUMMARY OF THE INVENTION

Thus, the present invention relates to a novel control process, which obviates the aforementioned disadvantages and which more particularly permits significant time savings in the replacement mode.

This control process is preferably used with plasma panels having a control circuit of the type described hereinbefore. However, it can apply to any control circuit in which the addresses of the active electrodes can be validated before the application of voltages corresponding to the instructions to be carried out. In addition, this control process can be used on plasma panels operating solely in the replacement mode, or operating both in the replacement mode and in the superimposing mode.

The present invention therefore specifically relates to a process for the control of an alternating current plasma panel operating in the superimposing and/or replacement mode, said process permitting the application of specific control signals between two electrodes belonging to two orthogonal electrode systems and the gaseous space located at the intersection of the two electrodes belonging to different systems constituting a cell of the panel, wherein it comprises:

addressing on one of the systems at least one group of electrodes with at least one electrode to be activated;

selecting the addressed electrodes as a function of the operating mode and an erase or writing instruction in such a way that in the superimposing mode the electrodes to be activated are selected no matter what the instruction and in the replacement mode the electrodes to be activated are selected during a writing instruction and the complementary electrodes of the electrodes to be activated are selected during an erase instruction;

selecting an electrode from the other system;

applying to the electrodes voltages such that a writing or erasure in accordance with the given instruction is carried out on the cells located at the intersection of two selected electrodes, the other cells being maintained in their initial state.

With this process, in order to carry out an image replacement, the points to be written are addressed and then the complementary points of the points to be written are erased, this being immediately followed by the writing of the points which are to be switched on. This operating procedure has the advantage of not rewriting the points which have just been erased, which increases the operating range of the plasma panel.

In addition, the address of the points to be entered is loaded as from the start, which obviates any address loading operation between the erasure of the preceding information and the writing of the new information and leads to a reduction in the time necessary for carrying out an image replacement.

The invention also relates to an apparatus for performing the process described hereinbefore. In the case of an integrated control circuit having a low voltage logic circuit defining the signal to be carried out, its duration and the electrodes of the panel to be activated and a low voltage–high voltage interface circuit, said apparatus is constituted by a validation circuit positioned between the addressing part of the logic circuit and the interface circuit which validates at the output either the electrodes to be activated, or the complementary electrodes of those which are to be activated, as a function of the writing or erase order to be performed and the selected operating mode.

BRIEF DESCRIPTION OF THE DRAWINGS

The invention is described in greater detail hereinafter relative to non-limitative embodiment and with reference to the attached drawings, wherein.

The same elements are designated by the same references in the drawings.

DESCRIPTION OF THE PREFERRED EMBODIMENT

Figure 1:
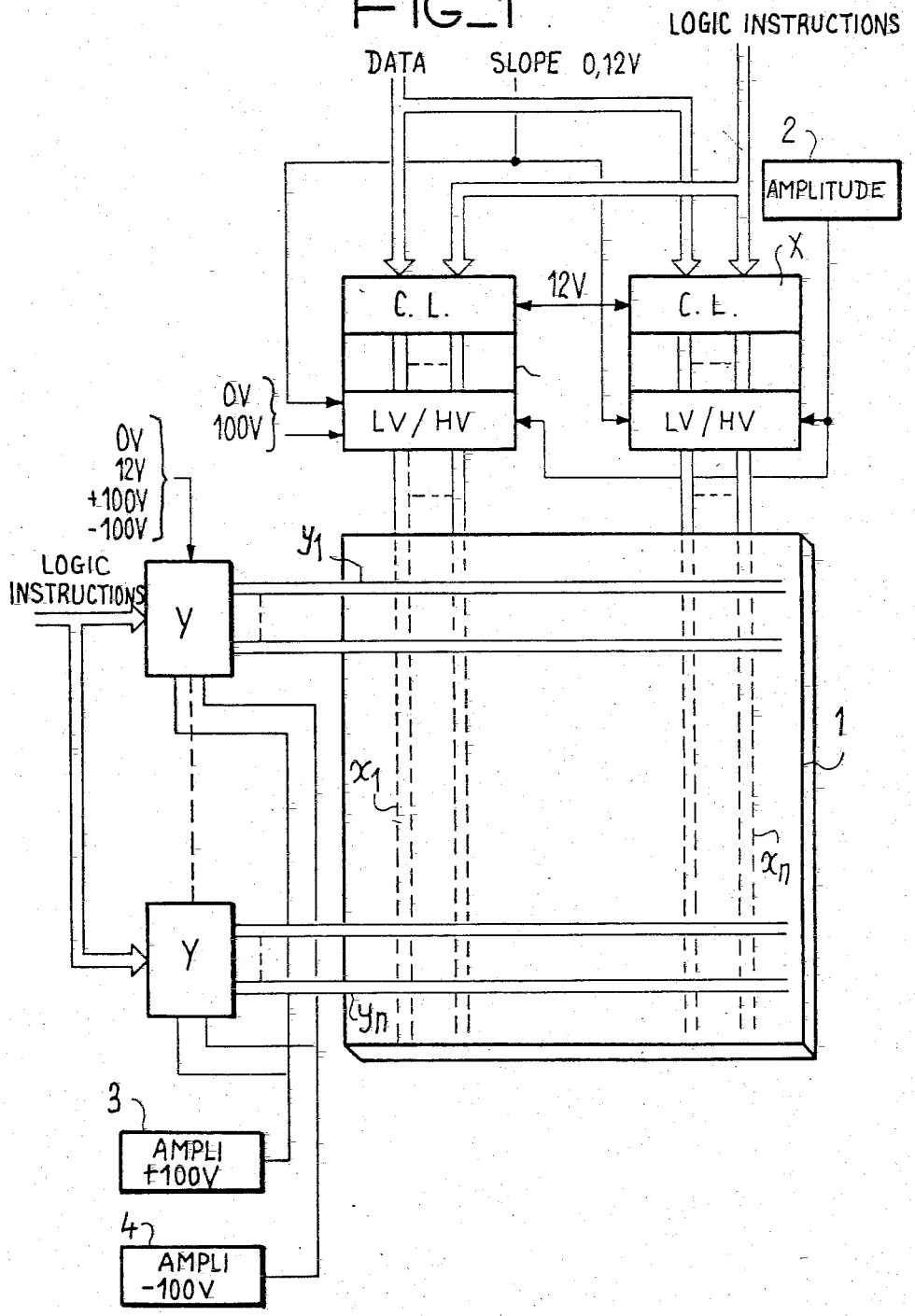
FIG. 1 a block diagram of a plasma panel and its control circuits.

FIG. 1 is a diagram showing the organization of a control circuit which can be used in the case of the present invention. In it, 1 designates the plasma panel, which has two orthogonal systems of electrodes, whereof the electrodes carry the references $x_1$ to $x_n$ and $y_1$ to $y_n$.

In the represented embodiment, control circuits are constituted by integrated circuits and amplifiers. The integrated circuits mainly comprise a logic circuit and a HV–LV interface formed in the present embodiment by control circuits as described in French Patent Application No. 81 19941, and corresponding U.S. patent application Ser. No. 431,152, but other interface types can be envisaged.

Thus, electrodes $x_1$ to $x_n$ are controlled by integrated circuits X. Each integrated circuit is constituted by a logic circuit, which will be described in greater detail relative to FIG. 2 and by a LV-HV interface. The logic circuit is supplied with 12 V and receives low voltage logic data and instructions defining the signal to be effected, its duration and the electrodes of the panel to be addressed. The LV/HV interface is supplied by d.c. voltages of values 0 V and 100 V and by a sloping low voltage signal, which generally increases from 0 to 12 V. It applies to the various electrodes to which it is connected, as a function of the addressing and the instruction, either a voltage or 0 V, or a sloping signal from 0 to 100 V, as will be explained hereinafter. With regards to electrodes $y_1$ to $y_n$, they are controlled by integrated circuits Y.

Two amplifiers 3 and 4 are associated with these integrated circuits. Integrated circuits Y are supplied by d.c. voltages of values 0, 12, +100 and −100 V. They receive low voltage logic instructions, which determine the address of the electrodes and the operation to be carried out, namely erasure or writing and they supply to the electrodes Y of the panel to which they are connected, either a voltage of 0 V or a voltage of substantially +100 V, or a voltage of substantially −100 V, as will be explained in greater detail hereinafter. In general, each integrated circuit X and Y can control 32 electrodes.

A plasma panel having 256 electrodes in X and 256 electrodes in Y will consequently have a control circuit formed of 8 integrated circuits X and a single amplifier for the control of the system of electrodes in X and 8 integrated circuits Y and two amplifiers for the control of the system of electrodes in y.

Figure 2:
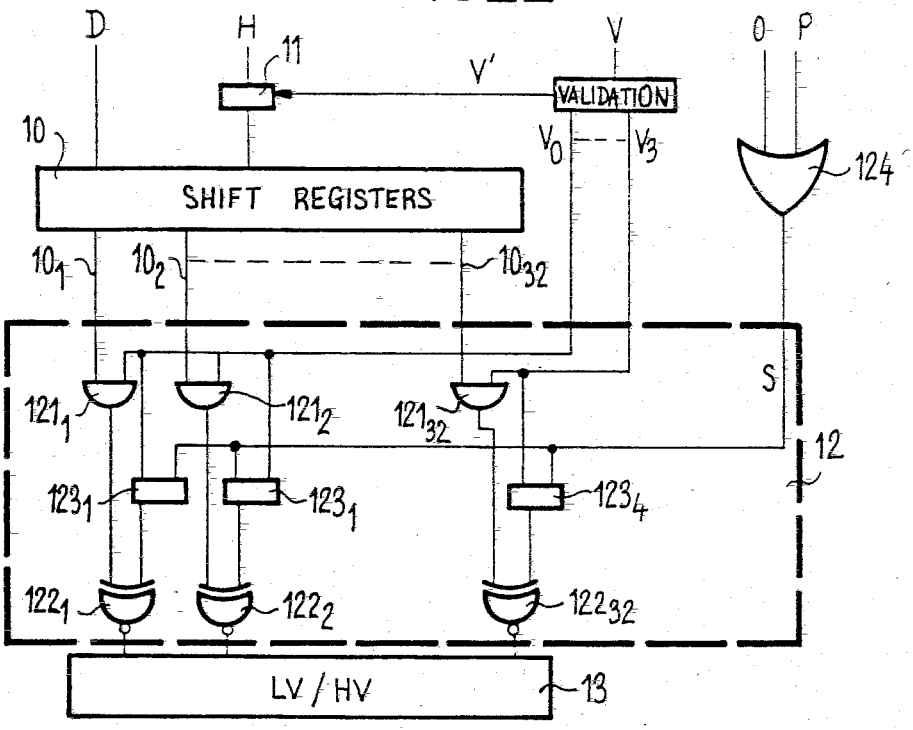
FIG. 2 a block diagram of the apparatus permitting the performance of the process according to the invention.

FIG. 2 is a diagram showing the structure of the logic circuit of the integrated circuits X permitting the realization of the process according to the invention.

Logic circuit C.L comprises a series—parallel shift register 10 having 32 outputs $\mathbf{10}_1$, $\mathbf{10}_2$, . . . $\mathbf{10}_{32}$ and an output validation circuit 12.

More specifically, the shift register comprises four shifts registers having 8 binary positions each, which can be arranged in cascade, which makes it possible to operate on groups of eight electrodes as explained hereinafter.

The register receives in series, logic data D defining electrodes to be activated, namely those to be written in the replacement mode or electrodes to be written or erased in the superimposing mode. These data are displaced under the action of a clock pulse H, which is validated for each circuit X by a validation circuit 11, as a function of a circuit validation pulse V'. In addition, octet validation pulses $V_o$ to $V_3$ make it possible to carry out a replacement or superimposing operation on groups of only 8 electrodes.

The output validation circuit 12 between shift register 10 and the LV/HV interface 13 comprises 32 AND circuits $\mathbf{121}_1$ to $\mathbf{121}_{32}$ receiving at the input the signal from the corresponding output of the shift register and a validation signal $V_o$ to $V_3$, as a function of its position. The AND circuits $\mathbf{121}_1$ to $\mathbf{121}_8$ receive signal $V_o$, while AND circuits $\mathbf{121}_9$ to $\mathbf{121}_{16}$ receive signal $V_1$, etc. Thus, these AND circuits $\mathbf{121}_1$ to $\mathbf{121}_{32}$ validate at least one group of 8 outputs of shift register 10.

Each output of AND circuits $121_1$ to $121_{32}$ is supplied to one of the inputs of a reversed exclusive-OR circuit $122_1$ to $122_{32}$, whose other input is validated by the output S of a validation circuit $123_1$ to $123_4$. The validation circuits $123_1$ to $123_4$ make it possible to validate the output of an OR circuit$_{124}$ as a function of the octet validation signals $V_o$ to $V_3$, so that in the replacement mode and with an erase instruction, only the cells of the validated octet or octets are erased. Each validation circuit $123_1$ to $123_4$ is in accordance with the following truth table:

| $V_{0;1,2,3}$ | S | S' |
|---|---|---|
| 1 | 0 | 0 |
| 1 | 1 | 1 |
| 0 | 0 | 1 |
| 0 | 1 | 1 |

In addition, an OR circuit$_{124}$ is provided upstream of the validation circuit to indicate the chosen operating mode and consequently permit an adequate selection of electrodes.

At its input, the OR circuit$_{124}$ receives a logic signal 0 corresponding to the instruction to be performed, namely writing or erasure and a logic signal P corresponding to superimposing or replacement mode operation. Signal 0 is chosen in such a way that it is at logic level 1 for a writing instruction and logic level 0 for an erase instruction. In the same way, signal P is at logic level 1 for operation in the superimposing mode and at logic level 0 for operation in the replacement mode.

In the case of the circuit described hereinbefore, with respect to the selected octet or octets, in the superimposing mode the electrodes addressed by a logic level 1 are validated no matter what the instruction, but in the replacement mode the electrodes addressed by a logic level 1 are validated when the instruction is a writing instruction and the electrodes addressed by a logic level 0 are validated when the instruction is an erase instruction.

A description will now be given with reference to FIGS. 3 to 6, of the process for producing control signals, as well as the sequence to be performed in the replacement mode.

Figure 3:
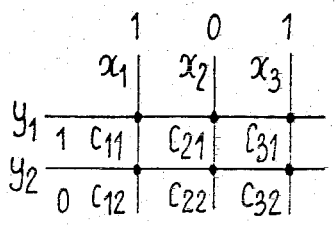
FIG. 3 a diagrammatic representation of several cells of a plasma panel.

FIG. 3 diagrammatically shows six cells $C_{11}$, $C_{21}$, $C_{31}$, $C_{12}$, $C_{22}$, $C_{32}$ of a plasma panel located at the intersections of two horizontal electrodes $y_1$, and $y_2$ and three vertical electrodes $x_1$, $x_2$ and $x_3$.

Using the processs according to the invention, in the replacement mode, it is assumed that it is wished to write into the cells $C_{11}$ and $C_{31}$ of row $y_1$. For this purpose, row $y_1$ and columns $x_1$ and $x_3$ are simultaneously or non-simultaneously selected. A logic level 1 for $y_1$ and a logic level 0 for $y_2$ and the other electrodes are reentered into the registers of the integrated circuits y corresponding to $y_1$ and $y_2$. In the same way, a logic level 1 for $x_1$ and $x_3$ and a logic level 0 for $x_2$ are reentered into the registers of integrated circuits X corresponding to $x_1$, $x_2$ and $x_3$. After loading the addresses of the electrodes to be activated, in accordance with the invention, the cells are erased which are not to be written on the selected row $y_1$, namely cell $C_{21}$.

FIGS. 4*a* and 4*b* show voltages $V_{x1}$, $V_{x2}$, $V_{x3}$, $V_{y1}$, $V_{y2}$ applied to electrodes $x_1$, $x_2$, $x_3$, $y_1$, $y_2$ in such a way that only cell $C_{21}$ is erased. These voltages will be described with reference to times $t_1$ to $t_6$ which succeed one another on the time axis:

voltages $V_{x1}$ and $V_{x3}$ are voltages which are constantly 0;

voltage $V_{x2}$ varies from time $t_3$ in substantially linear manner as a function of the time from 0 to $V_1$ equal to 100 V in the represented embodiment, then stabilizes at $V_1$ and drops again to 0 at time $t_5$—the use of such a voltage for erasing a cell has been described in the THOMSON-CSF French patent application No. 2 417 848, published Sept. 14, 1979;

voltage $V_{y1}$ has a positive part of amplitude +100 V from $t_1$ to $t_2$, a zero part from $t_3$ to $t_4$ and a negative amplitude part of −100 V from $t_5$ to $t_6$;

voltage $V_{y2}$ has a positive amplitude part of +100 V from $t_1$ to $t_2$ and $t_3$ to $t_4$ and a negative amplitude part of −100 V from $t_5$ to $t_6$.

Figure 4:
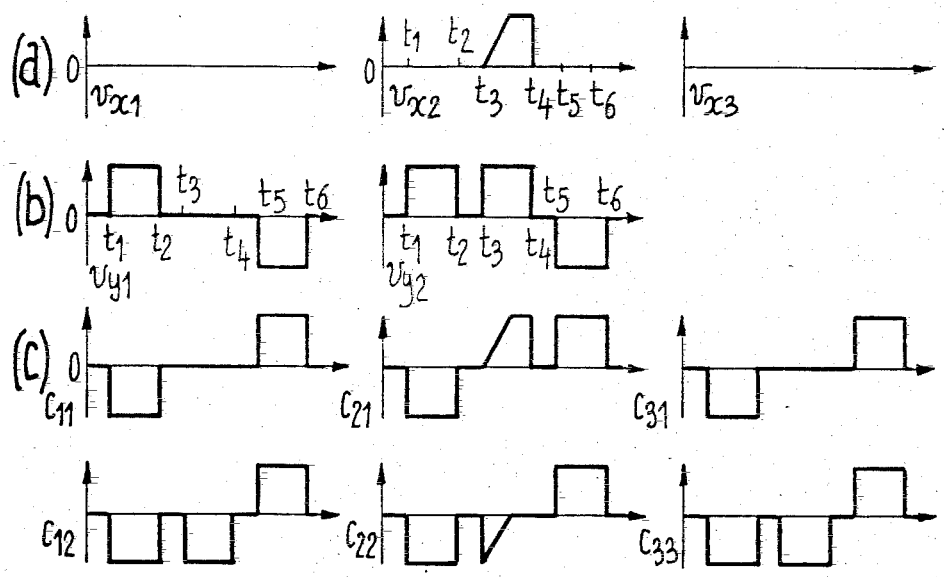
FIGS. 4(*a*) to 4(*c*) show voltages produced by the control circuit according to the invention.

FIG. 4(*c*) shows the control signals applied to cells $C_{11}$, $C_{21}$, $C_{31}$, $C_{12}$, $C_{22}$, $C_{32}$ corresponding to $V_x$–$V_y$. Only the signal applied to cell $C_{21}$ makes erasure possible as a result of that part of the voltage rising in a linear manner from 0 to $V_1$ from time $t_3$ to $t_4$. With regards to the other signals applied to the cells, there is a falling amplitude front $-V_1$ at time $t_1$ and a rising amplitude front $+V_1$ at time $t_5$, which corresponds to the characteristics of the maintenance signal and permits the display of the already entered information.

After erasing the cell addressed by a column at logic level 0, writing takes place into cells $C_{11}$ and $C_{31}$, whose columns are addressed by logic levels 1.

FIGS. 5(a) and (b) show voltages $V_{x1}$, $V_{x2}$, $V_{x3}$, $V_{y1}$, $V_{y2}$ applied to electrodes $x_1$, $x_2$, $x_3$, $y_1$, $y_2$ in such a way that writing only takes place in cells $C_{11}$ and $C_{31}$, so that:

voltages $V_{x1}$ and $V_{x3}$ vary from time $t'_3$ in a substantially linear manner as a function of time from 0 to +100 V, then stabilize at 100 V and then drop again to 0 at time $t'_4$;

voltage $V_{x3}$ is constantly 0;

voltage $V_{y1}$ has a negative amplitude portion of 100 V from $t'_1$ to $t'_2$ and $t'_3$ to $t'_4$ and a positive amplitude portion of +100 V from $t'_5$ to $t'_6$;

voltage $V_{y2}$ has a negative amplitude portion of −100 V from $t'_1$ to $t'_2$, a zero portion from $t'_3$ to $t'_4$ and a positive amplitude portion of 100 V from $t'_5$ to $t'_6$.

Figure 5:
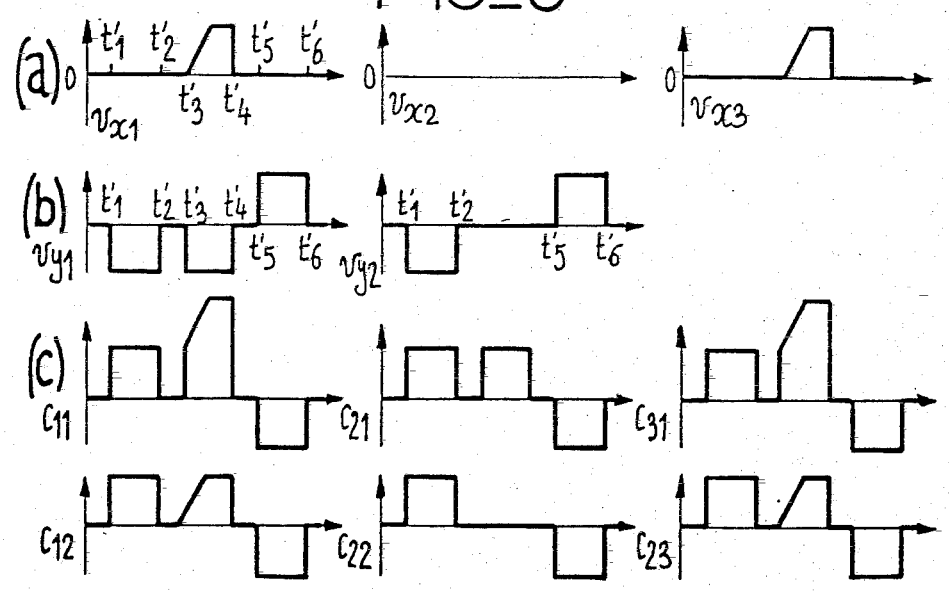
FIGS. 5(*a*) to 5(*c*) show the control signals received by the cells of FIG. 3 in the case of an erasure and a writing.

FIG. 5(*c*) shows the control signals applied to the different cells. It is clear that only the signals applied to $C_{11}$ and $C_{31}$ enable writing to take place in said cells as a result of the rising portion up to 200 V between $t'_3$ and $t'_4$, while the other cells are only maintained.

Figure 6:
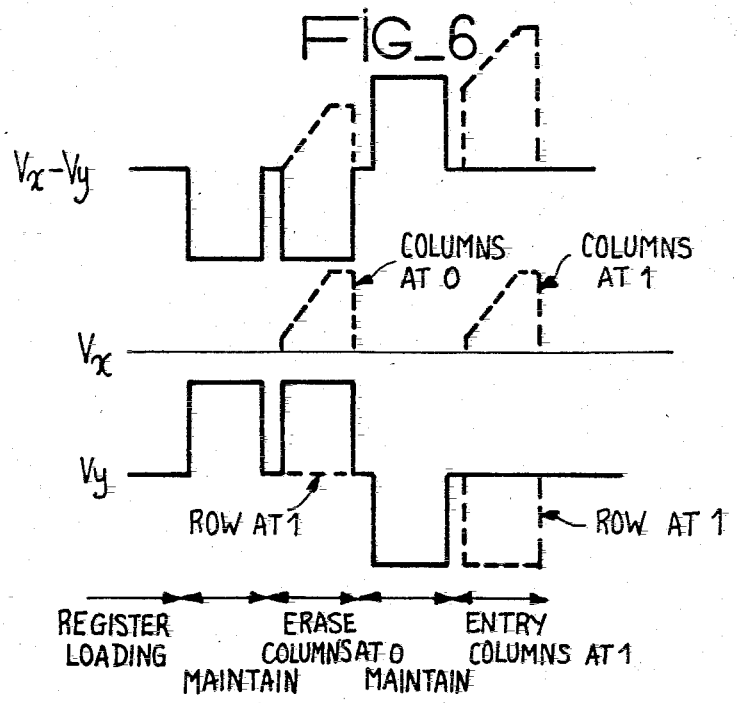
FIG. 6 is a representation of the voltages produced by the control circuit according to the invention and the control signals received by the cells during an information replacement sequence.

The sequence described hereinbefore is summarised in FIG. 6, in which is shown in dotted line form the amplitude of the voltages when the row is at logic level 1, as well as the signal to be applied to the column to be modified.

With respect to the superimposing mode, the signals to be applied for bringing about an erasure or a writing are the same as those described with reference to FIGS. 4 and 5, but in this case these signals are only applied to the selected electrodes, namely to the electrodes at logic level 1.

Thus, in the embodiment described hereinbefore, to columns x is applied a selection or non-selection voltage, as a function of the validation of the column according to the instruction to be performed, while to the rows y is applied a voltage which is a function of the instruction to be performed, namely maintenance or writing It is obvious to the expert that numerous modifications can be made to the present invention particularly with regards to the validation circuit used and the form of the signals applied to the electrodes. Moreover, the columns and rows can be reversed without passing beyond the scope of the invention.

What is claimed is:

1. A process, for the control of an alternating current plasma panel operating, selectively, in one of a superimposing mode and a replacement mode, said process permitting the application of specific control signals, namely writing signals, erase signals, and maintenance signals, between two electrodes belonging to first and second orthogonal electrode systems and a gaseous space located at the intersection of the two electrodes belonging respectively to different ones of said systems, said two electrodes and said gaseous space therebetween together defining a cell of the panel, comprising the steps of:

applying a selecting signal to an electrode of said first system;

addressing on the second system at least one group of electrodes with at least one electrode to be activated;

selecting the addressed electrodes as a function of the selected operating mode and of an instruction, selected from an erase instruction and a writing instruction, in such a way that when in the superimposing mode the electrodes to be activated are selected no matter what the instruction and when in the replacement mode the electrodes to be activated are selected during a writing instruction and the complementary electrodes of the electrodes to be activated are selected during an erase instruction;

applying, to the electrodes so selected, voltages such that a writing, in the case of a writing instruction, and an erasure in the case of an erasure instruction, is carried out on the cells located at the intersection of two selected electrodes, the other cells being maintained in their initial state.

2. A process according to claim 1, wherein in the replacement mode:

an electrode on one of the systems said first system is selected;

at least one group of electrodes with at least one electrode to be activated is addressed on the other system or second system;

the complementary electrodes of those to be activated are selected on the second system;

voltages are applied to the electrodes making it possible to only erase the selected electrodes;

the electrodes to be activated are selected on the second system;

voltages are applied to the electrodes making it possible to effect a writing only on the selected electrodes.

3. A process according to claim 1, wherein the two systems of electrodes are addressed simultaneously.

4. A process according to claim 1, wherein, as a function of the instruction, a writing or erase voltage is applied to the selected electrode of the first system and a maintain voltage to the other electrodes of this system, a so-called selection voltage is simultaneously applied to the selected electrodes of the second system and a so-called non-selection voltage is applied to the other electrodes of this system, the form, amplitude and duration of these various voltages being such that only the cells receiving the selection voltage on one electrode and the writing or erase voltage on the other electrode are written or erased, the other cells being maintained in their initial state.

5. A process according to claim 4, wherein the selection voltage increases in a linear manner as a function of the time from 0 to $V_1$, then stabilizes at $V_1$ before returning to 0, the nonselection voltage is 0, the writing voltage is negative and of amplitude $V_1$, the erase voltage is zero and the maintain voltage is positive of amplitude $V_1$ or zero, as a function of the entry or erase instruction.

6. A process according to claim 2, wherein, as a function of the instruction, a writing or erase voltage is applied to the selected electrode of the first system and a maintain voltage to the other electrodes of this system, a so-called selection voltage is simultaneously applied to the selected electrodes of the second system and a so-called non-selection voltage is applied to the other electrodes of this system, the form, amplitude and duration of these various voltages being such that only the cells receiving the selection voltage on one electrode and the writing or erase voltage on the other electrode are written or erased, the other cells being maintained in their initial state.

7. A process according to claim 6, wherein the selection voltage increases in a linear manner as a function of the time from 0 to $V_1$, then stabilizes at $V_1$ before returning to 0, the non-selection voltage is 0, the writing voltage is negative and of amplitude $V_1$; the erase voltage is zero and the maintain voltage is positive of amplitude $V_1$ or zero, as a function of the entry or erase instruction.

8. In an alternating current plasma display panel operating, selectively, in a superimposing mode and a replacement mode, and having a first system ($x_1$–$x_n$) of regularly spaced-apart electrodes, a second system ($y_1$–$y_n$) of groups of regularly spaced-apart electrodes spaced from, and orthogonal to, the electrodes of said first system, and a gas-filled space disposed between respective first and second electrodes of said systems at each intersection thereof, each said gas-filled space and its adjacent electrodes together defining a display cell of said panel, a method of changing an image displayed on said panel by addressing only once the display cells being changed, and applying, to the respective electrodes of each display cell, voltages corresponding to a single selected one of a writing instruction, an erase instruction, and an image maintenance instruction, comprising the steps of:

addressing (10), sequentially, cells to be activated or changed by applying a first low-voltage selection signal to an electrode ($x_n$) of said first system and simultaneously applying a second low-voltage selection signal ($V_0$–$V_3$) to at least one group of electrodes ($y_n$) of said second system and a non-selection signal to the remaining or complementary electrodes of said second system;

validating (12,124) the addressed electrodes as a function of (P) the selected operating mode and as a function of (O) a selected one of an erasure instruction and a writing instruction, in such a way so that when in the superimposing mode the electrodes of said second system to which are directed said second selection signal are validated, regardless of which of said writing and erasure instructions is selected, and when in the replacement mode, the electrodes of said second system to which are directed said second selection signal are validated when the selected instruction is a writing instruction and the remaining or complementary electrodes of said second system are validated when the selected instruction is an erase instruction; and applying control voltages, in accordance with said validation, to change the addressed cells and to maintain non-addressed cells in their previous display states.

9. The method of claim 8, wherein a first validation signal (0) is provided which has a value of logic level 1 in the case of a writing instruction and a value of logic level 0 in the case of an erasure instruction, and a second validation signal (P) is provided, having a value of logic level 1 in the case of said superimposing mode and a value of logic level 0 in the case of said replacement mode, said first and second validation signals being combined in a Boolean OR operation (124) with the result being used to control said validating step.

* * * * *